United States Patent [19]

Ollat et al.

[11] Patent Number: 4,890,881

[45] Date of Patent: Jan. 2, 1990

[54] MULTI-POSITION, FOLDABLE ARMCHAIR WITH ADJUSTABLE BACKREST INCLINATION AND SEAT HEIGHT

[75] Inventors: Marc Ollat, Oyonnax; Norbert Kleinklaus, Vaux Les Saint Claude, both of France

[73] Assignee: Grosfillex S.A.R.L., Oyonnax, France

[21] Appl. No.: 363,958

[22] Filed: Jun. 8, 1989

[30] Foreign Application Priority Data

Jun. 21, 1988 [FR] France ..... 88 08319

[51] Int. Cl.[4] ..... A47C 4/00

[52] U.S. Cl. ..... 297/26; 297/28; 297/57; 297/359

[58] Field of Search ..... 297/26, 27, 28, 41, 297/359, 57

[56] References Cited

U.S. PATENT DOCUMENTS

| | | | |
|---|---|---|---|
| 192,284 | 6/1877 | Richardson | 297/26 |
| 421,018 | 2/1890 | Stieler | 297/26 |
| 552,676 | 1/1895 | Lovejoy | 297/27 |
| 931,864 | 8/1909 | Hall | 297/26 X |
| 3,100,125 | 8/1963 | Crescent | 297/26 |

FOREIGN PATENT DOCUMENTS

| | | | |
|---|---|---|---|
| 269125 | 10/1950 | Switzerland | 297/57 |

*Primary Examiner*—Francis K. Zugel

*Attorney, Agent, or Firm*—Ladas & Parry

[57] ABSTRACT

This invention relates to a multi-position, foldable armchair whose backrest inclination and seat height are adjustable, comprising, on each side, a crossed support of which the rear leg is articulated about a pivot pin under the front part of a seat and of which the front leg is connected to the rear part of the latter by a finger-rack arrangement. It also comprises a backrest articulated about a pivot pin on the front leg. Finally, it comprises an armrest articulated about a pin on the backrest and connected by a pin-rack arrangement to a compass element of which the front arm is articulated about a pin on the seat and of which the rear arm is articulated about the pin on the front leg. According to the invention, the rack of the seat is disengageable from the finger of the front leg and the rack of the armrest is releasable from the finger of the compass element, so that the armchair can be folded down flat.

9 Claims, 5 Drawing Sheets

5
6
4
36
31
27
28
10
26
34
30
29
33
13
11
14
12
15
3
1
21
16
35
22
23
25
24
32
2
18
20
19
17
7
9
8

MULTI-POSITION, FOLDABLE ARMCHAIR WITH ADJUSTABLE BACKREST INCLINATION AND SEAT HEIGHT

FIELD OF THE INVENTION

The present invention relates to a multi-position, foldable armchair whose backrest inclination and seat level are adjustable.

BACKGROUND OF THE INVENTION

A known armchair of this type, which Applicants are exploiting, comprises on each side of the seat and the backrest:

a crossed support, whose front and rear legs are joined to each other, in their substantially median part, by a pivot pin, a seat, of which the front part is joined to the upper part of the rear leg by a pivot pin and of which the rear part is provided with a rack adapted to cooperate with a finger projecting from the upper part of the front leg, a compass element of which the rear arm is mounted to pivot about a pivot pin joining the lower part of the backrest to the upper part of the front leg, which pin is located above the finger of the front leg cooperating with the rack of the seat, and of which the front arm is connected to the seat by a pivot pin located between the rack thereof and its pivot pin on the front leg, an armrest, whose rear part is connected to an intermediate part of the backrest by a pivot pin and whose front part is provided with a rack adapted to cooperate with a finger projecting from the front arm of the compass element above the pivot pin of the two arms.

In this known armchair, the rear arm of each compass element is terminated by an elastically clippable hook so that, in position of use of the armchair, the hooks may pivot about the pivot pin of the backrest on the front leg during adjustment of the inclination of the backrest, the hooks having to be disengaged when the armchair is to be folded. Furthermore, the fingers of the compass elements are imprisoned in the racks of the armrests in a stroke limited to the pivoting of the backrest.

Consequently, it is relatively difficult to fold the armchair by oneself; as to unfolding, it requires a certain apprenticeship and perfect centering on both sides: in the notch selected out of the five notches of each lateral rack for adjusting the seat height and in the notch selected out of the four notches of each lateral rack for adjusting the inclination of the backrest.

This known armchair presents a second drawback resulting from its folding up by bringing the backrest onto the seat, straightening the crossed legs, disengagement of the hook on the rear arm of each compass element and flattening of each armrest on the front arm of the corresponding compass element. The armchair thus folded is difficult to store in a garden shed or sales store, since, due to its shape, it is unstable on its base and difficult to lean laterally against others. More important, from the economical standpoint, is that the storage volume in a vehicle for these folded armchairs contained in parallelepipedic cardboard packings is reduced: of the order of 5 to 6 armchairs per cubic meter. Consequently, transport costs are relatively high.

Another known armchair is marketed by Kettler. It comprises, like the preceding one:

a backrest and a seat mounted to pivot on each other, a crossed support, of which the two legs, located on each side, are articulated with respect to one another and connected to the seat; however, the front leg is articulated on the rear part of the seat, whilst the rear leg comprises a projecting finger cooperating with a front lateral rack on the seat, armrests articulated on the backrest and extending above the seat, each armrest being supported by an upright which, at the top, comprises a projecting finger cooperating with a front rack on the armrest in question and, at the bottom, is connected to the seat by a pivoting hub lockable for different inclinations with the aid of a lever.

This armchair is even more difficult than the preceding one to fold by oneself, as one would need three hands if not assisted. Furthermore, the mechanism of inclination and its lever are relatively fragile and, as they are subjected to intense stresses, they frequently break, rendering the use of the armchair dangerous.

More especially, this armchair which also folds down flat is difficult to store, the loading capacity of a vehicle is reduced, leading to relatively high transport costs.

A third known armchair is described in Italian Patent Application No. 5208 A/82. It resembles more the former and, in fact, comprises:

a backrest mounted to pivot on each side on a front leg which is articulated on a rear leg in order to constitute a crossed support, a seat of which the front part is articulated on each side of the corresponding rear leg and of which the rear part presents on each side a rack cooperating with a projecting finger located at the top of the front leg, armrests articulated on the backrest and extending above the seat, each armrest being supported by a compass element of which the two arms are articulated on each other at the top and connected by a finger to a front rack on the armrest in question, a front compass arm having a constant length and a telescopic rear arm of which the two parts are connected to each other by a lock-pusher making it possible, when it is actuated, to vary the length of said arm when the armchair is being folded down.

This third known armchair has the same drawbacks as the second: impossibility for one person to fold the armchair easily, fragility of the two lateral locks risking rendering the use of this armchair dangerous, storage of the folded armchair difficult and limited loading capacity of the means of transport.

It is an object of the present invention to overcome the above-mentioned drawbacks of the known armchairs by rendering folding and storage thereof without packaging simple and easy, considerably improving its robustness and reducing the space requirement of the folded and packaged armchairs so that the storage capacity of the transport vehicles is substantially increased, proportionally reducing transport costs.

SUMMARY OF THE INVENTION

To that end, the armchair of the invention is similar to the first known armchair mentioned above, and comprises on each side of the seat and the backrest:

a crossed support, of which the front and rear legs are connected to each other in their substantially median part by a pivot pin, a seat, of which the front part is connected to the upper part of the rear leg by a pivot pin and of which the rear part is provided with a rack adapted to cooperate with a finger projecting from the upper part of the front leg, a compass element, of which the rear arm is mounted to pivot about a pivot pin connecting the lower part of the backrest to the upper part of the front leg, which pin is located above the finger of the front leg, and of which the front arm is connected to the seat by a pivot pin, the two arms being connected together at their upper ends by a pivot pin, an armrest, of which the rear part is connected to an intermediate part of the backrest by a pivot pin and the front part is provided with a rack capable of cooperating with a finger projecting from a part of the compass element, and, according to the invention, on each side, the rack of the seat is disengageable from the finger of the front leg and the rack of the armrest is releasable relatively to the finger of the compass element, so that, in order to fold the armchair, the backrest may be brought into line with the front legs and, concomitantly, on the one hand, the armrests may be folded down on the backrest, whilst the compass elements flatten and, on the other hand, the seat is applied on the flattened assembly: backrest/front legs, whilst the rear legs fold on the front legs.

In a particularly advantageous embodiment, each rear rack of the seat opens out above a guide element maintaining the finger of the corresponding front leg prisoner during the adjustments of the height of this seat, this element defining a downward rear passage for the finger so that the rack in question may be disengaged.

The front rack of each armrest opens out above a guide element maintaining the finger of the corresponding compass element prisoner during the adjustment of inclination of the backrest, these rack and guide element being extended rearwardly by a slide allowing the finger to recoil without escaping the armrest in question when the armchair is being folded.

The finger of the front leg, cooperating with the rack of the seat, is located beneath the pin for articulation of this front leg on the backrest The finger of the compass element, cooperating with the rack of the armrest, is located on the front arm of this compass element above its pin for articulation on the rear arm.

The pin for articulation of the compass element on the seat is located between the rack of the seat and the pin for articulation of the latter on the rear leg.

As follows from the foregoing description, the armchair may be folded very easily and without effort by one person alone; it can be folded flat so that the space requirement of this folded armchair is much reduced; it is easy to store in a garden shed, for example, simply by leaning it against a wall; the loading capacity of such packed armchairs in a lorry or other means of transport is substantially increased and the transport costs thus reduced; furthermore, this armchair is highly aesthetic and is comfortable in any of its twenty positions; in addition, the passage from one position to another is easy and does not require any practice; finally, the armchair is extremely robust and solid.

BRIEF DESCRIPTION OF THE DRAWINGS

The invention will be more readily understood on reading the following description with reference to the accompanying drawings, in which.

Figure 1:
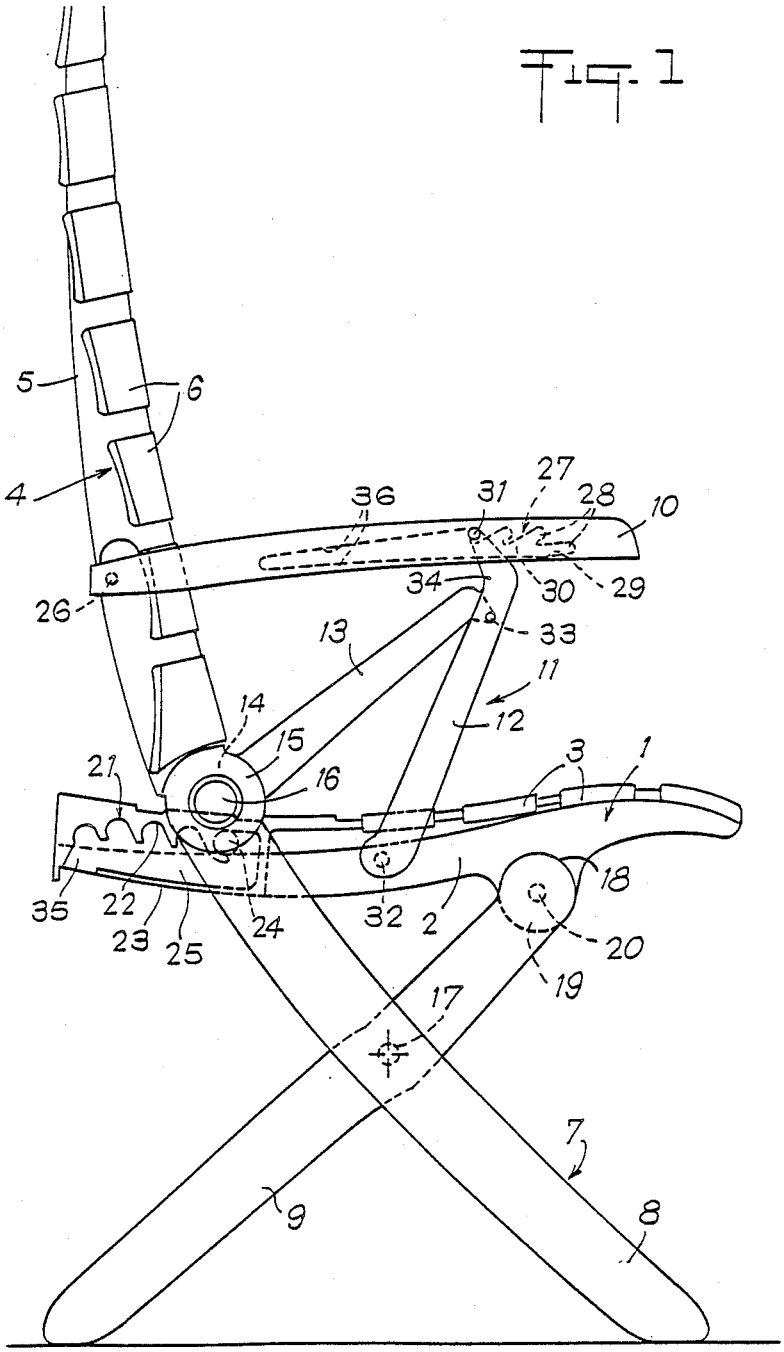
FIG. 1 is a view in elevation showing an embodiment of the armchair opened out in one of the twenty adjustable positions, corresponding to the high sitting position.

FIG. a view similar to FIG. 1 for a low sitting position.

Figure 3:
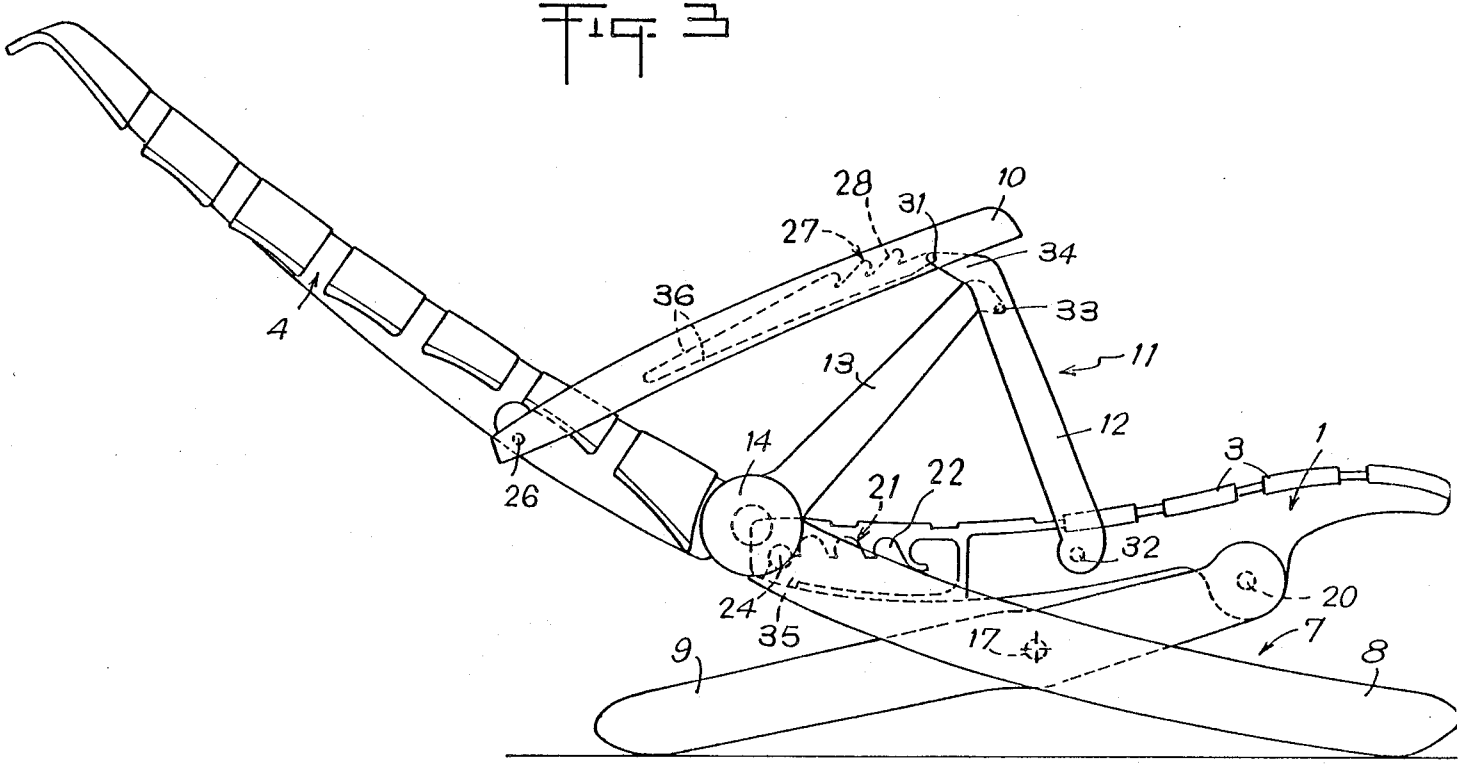

FIG. 3 is a view similar to FIG. 1 for the low reclining position.

Figure 4:
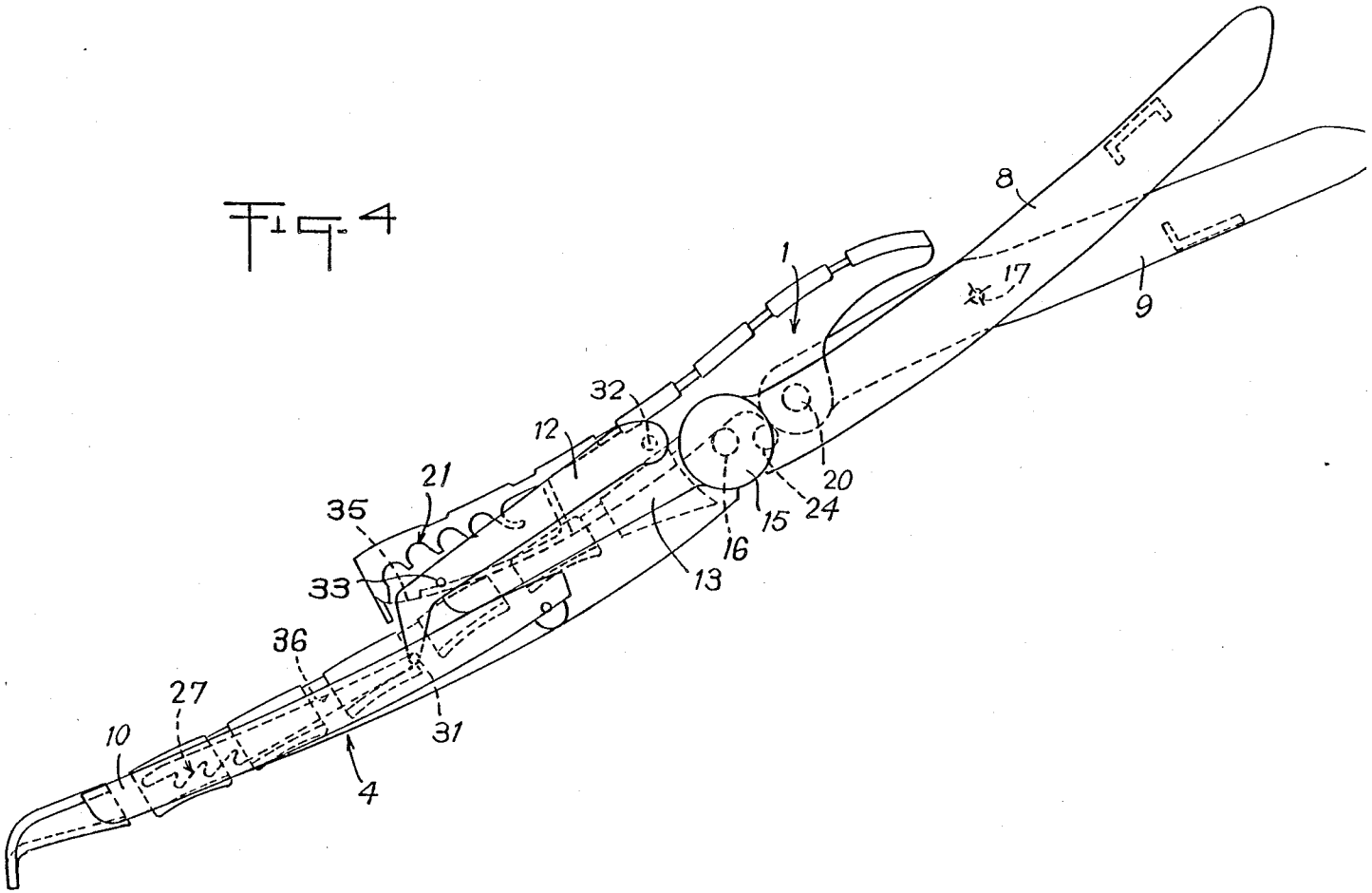
Figure 5:
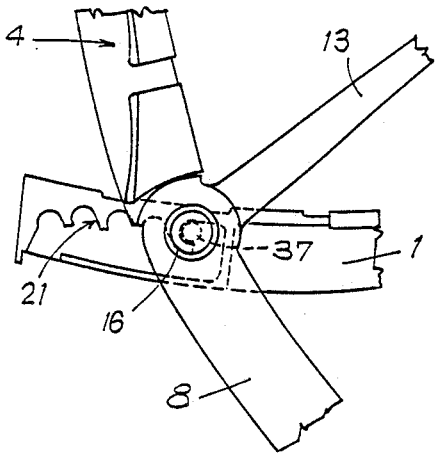
Figure 7:
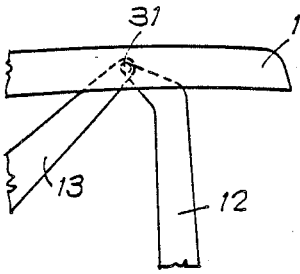
Figure 6:
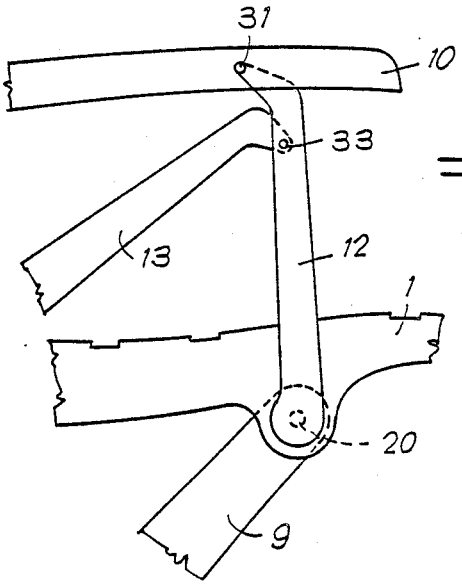

FIG. 4 is a view similar to FIG. 1 illustrating the armchair folded up, and FIGS. 5 to 7 are partial views respectively showing three variant embodiments of the armchair.

DETAILED DESCRIPTION OF THE DRAWINGS

Referring now to the drawings, FIGS. 1 to show that the armchair comprises:

a seat 1, of which the side elements 2 are integral with transverse slats 30, a backrest 4, of which the side elements are integral with transverse slats 6, an underframe constituted by two crossed supports 7 possibly connected together by bracing crosspieces (not shown), each crossed support comprising a front leg 8 and a rear leg 9, lateral armrests 10, compass elements 11 for supporting these armrests and presenting two articulated arms, a front arm 12 and a rear arm 13.

These components of the armchair and their connections, described in the following specification for the right-hand side, are preferably made of moulded plastics material.

Referring to FIG. 1, the lower end of the right-hand element 5 of the backrest 4 and the upper end of the front leg 8 are extended by eyes 14 and 15, respectively disposed side by side, and traversed by a pivot pin 16.

The front and rear legs, 8 and 9 respectively, of the right-hand crossed support 7 are connected to each other in their substantially median part by a pivot pin 17 which traverses them.

An eye 18 extending the upper end of the rear leg 9 is applied against an eye 19 projecting beneath the front part of the right-hand element 2 of the seat 1, these eyes 18 and 19 being connected to each other by a pivot pin 20 which traverses them.

The rear part of the right-hand element 2 of the seat 1 comprises a rack 21 of which five notches 22 open out above a substantially horizontal guide ramp 23. The notches 22 of the rack 21 are capable of cooperating selectively with a finger 24 projecting from the inner face of the upper end of the front leg 8 and in the cavity 25 defined by said rack 21 and said ramp 23. The finger 24 is located slightly beneath the pivot pin 16 of the front leg 8 on the backrest 4. This finger is prisoner in the cavity 25 but the distance from the rack to the ramp is greater than the diameter of the finger so that, by raising the seat 1 and modifying the opening of the crossed support 7, it is possible to change locking notch 22 and thus to adjust the height of this seat.

The rear end of the right-hand armrest 10 is connected to the corresponding side element 5 of the backrest 4 by a pivot pin 26 located above pin 16. The armrest 10 extends in a direction substantially parallel to the seat 1. Its front part defines an inner rack 27 of which four notches 28 open out above lateral guide ramps 29, defining a cavity 30 in which is imprisoned a finger 31 for supporting said armrest.

The rear arm 13 of the right-hand compass element 11 is mounted to pivot about the pivot pin 6 connecting the backrest 4 to the front leg 8. The front arm 12 of this compass element is connected to the right-hand side element 2 of the seat 1 by a pivot pin 32 located between pin 20 and rack 21. The two arms 12 and 13 of said compass element are connected together at their upper ends by a pivot pin 33.

A bent extension 34 of the upper end of the front arm 12 of the compass element extends between the ramps 29 of the right-hand armrest 10 and penetrates in the cavity 30 where the rack 27 is located. The extension 34 bears the finger 31 which projects from both sides above said ramps 29. The finger is therefore imprisoned in the cavity 30 and supports the armrest 10 by the compass element 11 by cooperating with the selected notch 28 of the rack 27. To change this notch, it suffices to raise the armrest and to displace it forwardly or rearwardly, which has for its effect to alter the inclination of the backrest.

FIG. 1 shows the armchair adjusted for the high sitting position. On each side, the finger 24 of the front leg 8 is housed in the first notch 22 located to the front of the rack 21 of the seat 1, with the result that the crossed support 7 is raised to a maximum; the finger 31 of the compass element 11 is housed in the last notch 28 located to the rear of the rack 27 of the armrest 10, with the result that the backrest 4 is upright to a maximum.

Figure 2:
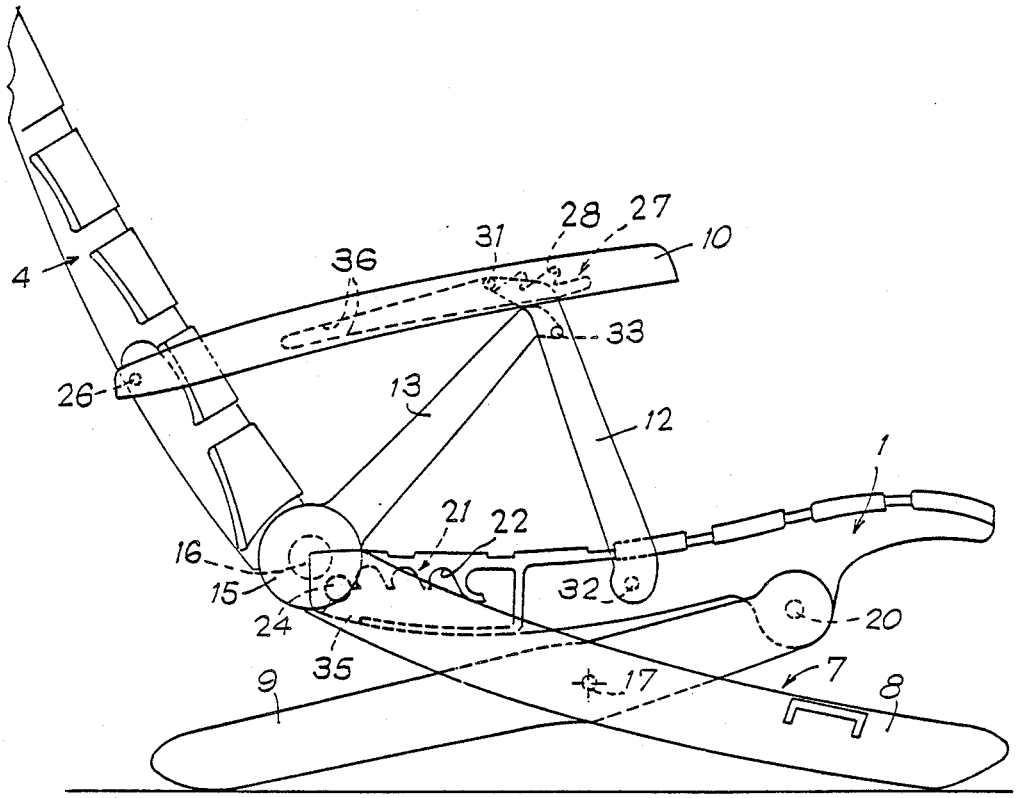

FIG. 2 shows the armchair adjusted for the low sitting position. On each side, the finger 24 is housed in the last notch 22 located to the rear of the rack 21, with the result that the crossed support 7 is flattened to a maximum; the finger 31 of the compass element 11 is still housed in the last notch 28 located to the rear of rack 27, with the result that the backrest 4 is upright to a maximum, although its inclination is less than in the preceding position.

FIG. 3 shows the armchair adjusted for the low reclining position. On each side, the finger 24 is housed in the last notch 22 located to the rear of the rack 21, with the result that the crossed support 7 is flattend to a maximum; the finger 31 of the compass element is now housed in the first notch 28 located to the front of the rack 27 of the armrest 10, with the result that the backrest 4 is lowered to a maximum and extends substantially in line with the seat 1.

As clearly shown in FIG. 1, each rack 21 of the seat 1 is disengageable from the finger 24 of the front leg 8. In fact, the guide ramp 23 is interrupted and defines a rear passage 35 which opens out downwardly and through which the finger 24 may be extracted, thus releasing the seat 1 relatively to the rear legs 9.

Moreover, the rack 27 of each armrest 10 is releasable relatively to the finger 31 of the corresponding compass element 11. To that end, and according to the particularly advantageous embodiment shown in this FIG. 1, the rack 27 and the ramps 29 are extended by a slide 36 extending rearwardly. In this way, the finger 31 may move closer to pin 26 as far as is desired to fold the armchair as described hereinafter. Beforehand, it should be noted that the rack 27 may also be disengaged from the finger 31 in the same way as rack 21 is disengaged relatively to finger 24.

In order to fold the armchair as illustrated in FIG. 4, it is necessary:

to release the seat 1 by disengaging the from the fingers 24, to bring the backrest 4 in line with the front legs 8, to flatten the crossed supports 7 and compass elements 11, concomitantly folding down, on the one hand, the armrests 10 along the backrest 4 by pivoting, about axes 26, their front ends towards the top of the backrest and, on the other hand, the seat 1 on the backrest 4 by pivoting, about axes 19, its rear end upwardly.

Another manner of defining the invention consists in considering on each side:

the deformable triangle whose sides are constituted by the front leg 8, the rear leg 9 and the seat 1, whilst the angles are constituted by pins 17, 19 and finger 24, the deformable convex pentagon whose five sides are constituted by the seat 1, the front arm 12 of the compass element, the armrest 10, the backrest 4 and the front leg 8, whilst the angles are constituted by pin 32, finger 31, pins 26, 16 and finger 24, the rear arm 13 of the compass element extending substantially diagonally between pins 16 and 33.

It is then ascertained that, after release of the racks 21 and 27, the triangle and pentagon change into a single pentagon whose sides are constituted by the seat 1, the front arm 12 of the compass element, the rear arm 13 of the compass element, the front leg 8 and the rear leg 9, whilst the angles are constituted by pins 32, 33, 16, 17 and 19, the converted polygon provoking, when it is flattened, folding down of the corresponding armrest 10 which, pushed by the finger 31 of the front arm 12, pivots about pin 26 of backrest 4 until it is applied thereagainst.

A first variant embodiment of the armchair is illustrated in FIG. 5, wherein the finger 24 cooperating with the rack 21 of the seat 1 is a journal 37 coaxially extending in projection the pivot pin 16 connecting the backrest 4 to the front leg 8.

A second variant embodiment of the armchair is illustrated in FIG. 6, wherein the pivot axis 32 of the lower end of the front arm 12 of the compass element merges with the pivot axis 20 of the seat 1 on the rear leg 9.

A third variant embodiment of the armchair is illustrated in FIG. 7, wherein the pivot pin 33 of the arms 12 and 13 of the compass element 11 constitutes the finger 31 cooperating with the rack 27 of the armrest.

What is claimed is:

1. In a multi-position, foldable armchair, of which the backrest inclination and seat height are adjustable, comprising on each side of the seat and the backrest:

a crossed support, of which the front and rear legs are connected to each other in their substantially median part by a pivot pin, a seat, of which the front part is connected to the upper part of the rear leg by a pivot pin and of which the rear part is provided with a rack adapted to cooperate with a finger projecting from the upper part of the front leg, a compass element, of which the rear arm is mounted to pivot about a pivot pin connecting the lower part of the backrest to the upper part of the front leg, and of which the front arm is connected to the seat by a pivot pin, the two arms being connected together at their upper ends by a pivot pin, an armrest, of which the rear part is connected to an intermediate part of the backrest by a pivot pin and the front part is provided with a rack capable of cooperating with a finger projecting from a part of the compass element, on each side, the rack of the seat is disengageable from the finger of the front leg and the rack of the armrest is releasable relatively to the finger of the compass element, so that, in order to fold the armchair, the backrest may be brought into line with the front legs and, concomitantly, on the one hand, the armrests may be folded down on the backrest, whilst the compass elements flatten and, on the other hand, the seat is applied on the flattened assembly: backrest/front legs, whilst the rear legs fold on the front legs.

2. The armchair of claim 1, wherein each rear rack of the seat opens out above a guide element maintaining the finger of the corresponding front leg prisoner during the adjustments of the height of this seat, this element defining a downward rear passage for the finger so that the rack in question may be disengaged.

3. The armchair of claim 1, wherein the front rack of each armrest opens out above a guide element maintaining the finger of the corresponding compass element prisoner during the adjustments of inclination of the backrest, these rack and guide element being extended rearwardly by a slide allowing the finger to recoil without escaping the armrest in question when the armchair is being folded.

4. The armchair of claim 1, wherein the finger of the front leg, cooperating with the rack of the seat, is located beneath the pin for articulation of this front leg on the backrest.

5. The armchair of claim 1, wherein the finger of the compass element, cooperating with the rack of the armrest, is located on the front arm of this compass element above its pin for articulation on the rear arm.

6. The armchair of claim 1, wherein the pin for articulation of the compass element on the seat is located between the rack of the seat and the pin for articulation of the latter on the rear leg.

7. The armchair of claim 1, wherein the finger of the front leg cooperating with the rack of the seat merges with the pivot axis of the backrest on said front leg.

8. The armchair of claim 1, wherein the finger of the compass element cooperating with the rack of the armrest merges with the pivot axis of the two arms of the compass element.

9. The armchair of claim 1, wherein the pin for articulation of the rear leg on the seat merges with the pivot axis of the compass element on said seat.

* * * * *